US008702082B2

(12) United States Patent
Amouroux et al.

(10) Patent No.: US 8,702,082 B2
(45) Date of Patent: Apr. 22, 2014

(54) PROFILE RAIL FOR POSITIONING A FIXING ELEMENT AND METHOD FOR PRODUCING A MULTIPLE GLAZING UNIT

(75) Inventors: Bernard Amouroux, Villevielle (FR); Eric Marsaglia, Mauguio (FR)

(73) Assignee: Alcoa Aluminium Deutschland, Inc., Iserlohn (DE)

( * ) Notice: Subject to any disclaimer, the term of this patent is extended or adjusted under 35 U.S.C. 154(b) by 1078 days.

(21) Appl. No.: 12/526,257

(22) PCT Filed: Feb. 6, 2008

(86) PCT No.: PCT/EP2008/051432

§ 371 (c)(1),
(2), (4) Date: Mar. 10, 2010

(87) PCT Pub. No.: WO2008/095946

PCT Pub. Date: Aug. 14, 2008

(65) Prior Publication Data

US 2010/0181713 A1 Jul. 22, 2010

(30) Foreign Application Priority Data

Feb. 7, 2007 (EP) ..... 07101933

(51) Int. Cl.

| | |
|---|---|
| ***B25B 5/16*** | (2006.01) |
| ***B25B 1/24*** | (2006.01) |
| ***E06B 7/00*** | (2006.01) |
| ***E04C 5/00*** | (2006.01) |

(52) U.S. Cl.
USPC ..... 269/257; 269/329; 52/656.6; 52/204.595

(58) Field of Classification Search
USPC ..... 269/257; 52/656.5, 202, 235, 506.1, 52/511, 204.595, 843, 206, 209, 773, 656, 52/282.1
See application file for complete search history.

(56) References Cited

U.S. PATENT DOCUMENTS 3,751,868 A * 8/1973 Mascioletti ..... 52/843
4,040,219 A * 8/1977 Budich ..... 52/209

(Continued)

FOREIGN PATENT DOCUMENTS

DE 3626194 2/1988
EP 1335079 8/2003

(Continued)

OTHER PUBLICATIONS

English Translation of International Search Report and Written Opinion, mailed Aug. 12, 2008, from corresponding International Application No. PCT/EP2008/051432.

*Primary Examiner* — Alvin Grant
(74) *Attorney, Agent, or Firm* — Greenberg Traurig, LLP

(57) ABSTRACT

A method for producing a multiple glazing unit (100). According to the invention, a fixing element (21) can be positioned in a groove (N), between two planar elements (101, 102), forming the multiple glazing unit (100), in a simple manner and provisionally fixed during the production of the multiple glazing unit (100) without loss of the required positional accuracy of the fixing element (21) in the groove (N), wherein during the production of the multiple glazing unit (100), a profile rail (1) with at least one first leg section (10), a second leg section (20) and a bridge section (30) connecting the first and second leg sections (10, 20) is used. The second leg section (20) of the profile rail (1) is detachably connected to the bridge section (30, 31) and has a profile element (21) which is essentially U-shaped in cross-section and the fixing element, for positioning in the groove (N) formed between the two boundary sections (101', 102') of the planar elements (101, 102), is formed by the profile element of the profile rail (1), said element being essentially U-shaped in cross-section.

24 Claims, 5 Drawing Sheets

(56) References Cited

U.S. PATENT DOCUMENTS

| | | | | | |
|---|---|---|---|---|---|
| 4,258,519 | A | * | 3/1981 | Hugens | 52/282.1 |
| D260,075 | S | * | 8/1981 | Baker, Sr. | D8/377 |
| 4,555,884 | A | * | 12/1985 | van Eerden | 52/204.591 |
| 4,598,513 | A | * | 7/1986 | Gartner | 52/206 |
| 4,740,405 | A | * | 4/1988 | Tanaka et al. | 428/45 |
| 4,962,918 | A | * | 10/1990 | Yang | 269/156 |
| 5,105,596 | A | * | 4/1992 | Wertitsch et al. | 52/204.591 |
| 5,187,867 | A | * | 2/1993 | Rawlings | 29/897.312 |
| 5,199,236 | A | * | 4/1993 | Allen | 52/235 |
| 5,355,645 | A | * | 10/1994 | Farag | 52/235 |
| 5,381,637 | A | * | 1/1995 | Farag | 52/204.595 |
| 5,456,054 | A | * | 10/1995 | Coupet | 52/773 |
| 5,758,870 | A | * | 6/1998 | Weaver | 269/329 |
| 5,857,298 | A | * | 1/1999 | Fullwood | 52/202 |
| 5,884,361 | A | * | 3/1999 | Richardson et al. | 16/100 |
| 5,993,311 | A | * | 11/1999 | Feller et al. | 454/187 |
| 6,170,214 | B1 | * | 1/2001 | Treister et al. | 52/511 |
| 6,289,646 | B1 | * | 9/2001 | Watanabe | 52/506.01 |
| 6,393,778 | B1 | * | 5/2002 | Ting | 52/204.5 |
| 6,893,012 | B2 | * | 5/2005 | Wong | 269/249 |
| 7,380,384 | B2 | * | 6/2008 | Bourly | 52/656.6 |
| 7,882,675 | B2 | * | 2/2011 | Lundgren | 52/656.5 |
| 8,047,494 | B2 | * | 11/2011 | Chang | 248/316.1 |
| 2004/0028921 | A1 | * | 2/2004 | Amouroux | 428/459 |
| 2008/0136079 | A1 | * | 6/2008 | Bernardi | 269/257 |
| 2010/0181713 | A1 | * | 7/2010 | Amouroux et al. | 269/257 |

FOREIGN PATENT DOCUMENTS

| | | |
|---|---|---|
| FR | 2222523 | 10/1974 |
| GB | 948032 | 1/1964 |
| GB | 2296279 | 6/1996 |

* cited by examiner

PROFILE RAIL FOR POSITIONING A FIXING ELEMENT AND METHOD FOR PRODUCING A MULTIPLE GLAZING UNIT

CROSS REFERENCE TO RELATED APPLICATIONS

This application is a 35 U.S.C.§371 national phase application of International Application No. PCT/EP2008/051432, filed Feb. 6, 2008, by applicant Alcoa Aluminium Deutschland, Inc., entitled "PROFILE RAIL FOR POSITIONING A FIXING ELEMENT AND METHOD FOR PRODUCING A MULTIPLE GLAZING UNIT," which claims priority to European Application No. EP 07101933.5, filed Feb. 7, 2007. Each of the above-identified patent applications is incorporated herein by reference in its entirety.

The present invention relates to a profiled rail for positioning a fixing element in a groove formed between two planar elements spaced apart from each other during the production of a multiple glazing unit and a method for producing a multiple glazing unit.

Patent document DE 195 47 444 A1 describes a method for producing a multiple glazing unit, said multiple glazing unit, which is produced by using the conventional method, comprising two planar elements which are positioned opposite each other and spaced apart from each other and which define between them a gas space limited by a circumferentially extending spacer. In this prior multiple glazing unit a material rim made of a resin or a resin rim, respectively, which extends between the spacer and each of the planar elements, serves to hold the spaced apart planar elements in position. Further, a fixing element is embedded in the resin rim so as to form a device for fixing the multiple glazing unit to a support structure. The fixing element has the shape of a profile having a U-shaped cross section with two leg sections connected to each other by a connecting section, and is formed to define an outwardly open channel which serves to receive a support element of the support structure, said support element being complementary with respect to the cross-sectional shape of the channel.

To produce such a multiple glazing unit it is proposed in patent document DE 195 47 444 A1 to fix the fixing element on a marginal section of the two planar elements, which eventually form the multiple glazing unit, only provisionally at first. Then, the resin rim is to be formed in the groove defined by the two spaced apart planar elements and the spacer, namely by introducing a preferably resinous material into this groove in such a way that the fixing element provisionally fixed on the marginal section of the planar element is enclosed by the resin material and held in the same permanently and non-positively after the resin material has hardened.

In view of provisionally fixing the fixing element on the one marginal section of the two planar elements it is provided according to the prior art to glue the fixing element with one of its leg sections onto the respective marginal section by means of an adhesive or double-coated adhesive tape. During the production of the multiple glazing unit this should preferably be accomplished before the two planar elements are arranged relative to each other in the face-to-face and spaced apart relationship.

As the fixing element had already been glued onto the marginal section of one of the two planar elements prior to the arrangement of the two planar elements, this fixing element is directly provided adjacent to the marginal section of the one planar element and within the groove formed by the respective marginal sections of the planar elements and the spacer after the arrangement of the two planar elements.

Thus, the known method allows the production of a ready-to-mount multiple glazing unit which is suited for use in a structure glazing technique. This structure glazing technique allows to cover, for example, facades with a structure glazing unit in such a way that no carrier profiles are visible from outside.

However, the method for producing such a multiple glazing unit known from the prior art has the disadvantage that, when provisionally fixing the fixing element on the marginal section of the one planar element, an exact positioning of the fixing element in the groove formed by the respective marginal sections of the planar elements and the spacer is relatively time-consuming and labor-intensive. To continuously permit a high quality of the finished multiple glazing units it is, however, particularly required that, when provisionally fixing the fixing element on the marginal section of the one planar element, the free ends of the leg sections of the fixing element end as flush as possible with the respective edges of the two planar elements and, above all, do not project over the level of the respective edges of the planar elements. Otherwise there is the danger that the fixing element of the completed multiple glazing unit cannot optimally receive the support element of the support structure.

In order to achieve the required position accuracy of the fixing element in the groove formed between the two spaced apart planar elements, the method for producing a multiple glazing unit known from the prior art initially requires the controlled application of the adhesive tape or the adhesive onto the marginal section of the planar element or onto the leg section of the fixing element formed as a profile with a U-shaped cross section. Then, the fixing element has to be positioned on the marginal section of the planar element as exactly as possible and pressed against it. These working steps required both for positioning the fixing element In the groove formed between the two spaced apart planar elements and provisionally fixing the fixing element on the marginal section of the one planar element should be performed and controlled by skilled personnel, so that the production process for the multiple glazing unit is not only relatively time-consuming, but also labor-intensive.

On the other hand, the method known from the prior art does not allow, or only with great efforts, to position the fixing element in the groove formed between the two spaced apart planar elements and the spacer subsequently, i.e. after the two planar elements were arranged in their face-to-face, spaced apart relationship. Also, it is impossible to provisionally fix the fixing element in the groove in such a way that the fixing element is not directly adjacent to a marginal section of one of the two planar elements.

Accordingly, the method known from the prior art is not suited for producing multiple glazing units where the fixing element has to be arranged, for example, in the center between the two spaced apart planar elements.

On the basis of the above-described problems the present invention is, therefore, based on the primary object to provide a method for producing a multiple glazing unit according to which the fixing element can be positioned substantially more easily and fixed provisionally in the groove formed between the two planar elements before or after incorporating a filling material, especially a resin or silicone material, used for forming a material rim in the groove formed between the two planar elements, without a deterioration of the positioning accuracy of the fixing element in the groove. Specifically, an easily realizable method for producing a multiple glazing unit is to be provided, which allows the production of multiple glazing units with a continuously good quality at a reduced number of working steps.

According to the invention this object is achieved by employing during the production of the multiple glazing unit a profiled rail comprising at least one first leg section, a second leg section and a bridging section connecting the first and second leg section, wherein the second leg section of the profiled rail is separably connected to the bridging section and comprises a profile element having a substantially U-shaped cross section, and wherein the fixing element to be positioned in the groove formed between the two marginal sections of the planar elements is formed by the profile element of the profiled rail, the cross section of the profile element being substantially U-shaped.

With respect to the profiled rail used for the production of the multiple glazing unit it is provided that the first and second leg sections are formed on the bridging section in such a way that the profiled rail is non-positively connectable to at least one marginal section of the two planar elements, so that the at least one marginal section is received in a space defined between the first and the second leg section and the second leg section is held in the groove formed between the two planar elements spaced apart from each other.

Concerning the method for producing a multiple glazing unit it is specifically provided to initially provide the profiled rail with the at least one first leg section, the second leg section and the bridging section connecting the first and the second leg section and two preferably vitreous planar elements. Next, the two planar elements are arranged in a face-to-face and spaced apart relationship, wherein the spacing between the planar elements is defined by a spacer arranged between the planar elements, and wherein the two planar elements are arranged in such a way that a gas space is enclosed between the spaced apart planar elements and the spacer on the one hand, and that a groove extending at least partially peripherally is formed with the respective marginal sections of the planar elements and the spacer on the other hand. Then, a material rim is formed in the groove, namely by incorporating a filling material into the groove, especially a resin or silicone material.

According to the invention, in the method it is provided that, either before of after the method step of forming the material rim in the groove, the profiled rail is placed onto the groove formed with the respective marginal sections of the planar elements and the spacer in such a way that at least one marginal section of the two planar elements is received in a space defined between the first and the second leg section of the profiled rail and the second leg section of the profiled rail is held in the groove formed between the two planar elements spaced apart from each other. Finally, the connection between the second leg section and the bridging section of the profiled rail is separated so as to obtain the multiple glazing unit with the fixing element held in the material rim.

If the method step of the inventive method of placing the profiled rail onto the groove is performed prior to the method step of forming the material rim in the groove, it is preferred that during the method step of forming the material rim in the groove the filling material is incorporated into the groove in such a way that the second leg section of the profiled rail is at least partially enclosed by the filling material.

If, on the other hand, the method step of the inventive method of placing the profiled rail onto the groove is performed after the method step of forming the material rim in the groove, it is preferred that the profiled rail is placed onto the groove in such a way that the second leg section of the profiled rail is at least partially enclosed by the filling material incorporated into the groove.

According to a preferred realization of the method according to the invention a resin material, which is preferably curable at room temperature, or a silicone material, which is preferably polymerizable at room temperature, is used as filling material for forming a material rim in the groove. Advantageously, the silicone material should be a material which is at least partially permanently elastic in a polymerized state. Of course, also other materials may be used.

Further advantageous developments of the profiled rail employed during the production of a multiple glazing unit for positioning and provisionally fixing a fixing element in the groove formed between the two marginal sections of the planar elements are defined in the dependent claims.

Thus, it is provided according to a specifically preferred embodiment that the first and second leg sections of the profiled rail are formed on the bridging section of the profiled rail in such a way that the profiled rail can be placed over at least one of the two marginal sections of the two planar elements. Specifically, it is possible that the first and second leg sections are formed on the bridging section in such a way that the profiled rail can be placed over at least one marginal section of the two planar elements, so that the at least one marginal section is positively received in the space defined between the first and the second leg section and the profiled rail is non-positively and positively held in the groove between the two spaced apart planar elements of the multiple glazing unit.

Preferably, this non-positive and positive holding of the second leg section of the profiled rail in the groove between the two spaced apart planar elements of the multiple glazing unit is achieved by at least one of the first leg sections comprising at least one lateral web extending substantially perpendicularly to the bridging section, wherein the spacing between the lateral web of the first leg section and the side facing the first leg section of the profile element having a substantially U-shaped cross section of the second leg section is substantially identical with the thickness of the marginal section of the planar element received in the space defined between the first and the second leg section if the profiled rail is placed over the marginal section of the planar element.

Alternatively or additionally it is also possible that at least one first leg section comprises at least one lateral web extending substantially perpendicularly to the bridging section with at least one holding web standing away from the lateral web in the direction to the second leg section, wherein the spacing between the at least one lateral web of the first leg section and the side facing the first leg section of the profile element having a substantially U-shaped cross section of the second leg section is greater than the thickness of the marginal section of the planar element received in the space defined between the first and the second leg section if the profiled rail is placed over the marginal section of the planar section, wherein the at least one holding web standing away from the lateral web is formed in such a way that, if the profiled rail is placed over the marginal section of the planar element, it abuts against the side of that planar element the marginal section of which is received in the space defined between the first and the second leg section, said side facing the first leg section.

According to a specifically preferred realization of the at least one holding web standing away from the lateral web of the first leg section it is provided that this holding web is formed as a preferably leaf-shaped element being resilient in the direction of the associated lateral web. However, alternatively or additionally it would also be possible that the at least one holding web standing away from the at least one lateral web of the first leg section is made of a flexible material and, in contrast to the material of the lateral web, is of a soft consistency.

In order to achieve that the fixing element cannot only be positioned directly adjacent to the marginal section of one of the two planar elements it is provided according to a preferred further development of the profiled rail employed during the production of the multiple glazing unit that the profiled rail comprises a total of two first leg sections, which are connected to the bridging section in such a way that the second leg section is arranged between the two first leg sections, and that a space is defined between one of the first leg sections and the second leg section, wherein the two first leg sections are formed in such a way that the profiled rail can be placed over both marginal sections of the planar elements, so that the respective marginal sections of the two planar elements are received in a respective one of the spaces defined with the leg sections and the second leg section is held in the groove between the two planar elements spaced apart from each other.

In an preferred realization of the profiled rail it is finally intended that the second leg section is connected to the bridging section by a predetermined breaking point, by means of which it can be achieved that after forming the material rim in the groove formed between the two planar elements arranged to be spaced apart from each other, and preferably after the (at least partial) curing or polymerizing of the filling material used for forming the material rim, the second leg section can be separated from the profiled rail or the bridging section, respectively.

Furthermore, it is preferably provided that the bridging section of the profiled rail is in cross section at least of the same length as the spacing between the planar elements. This measure facilitates the incorporation of the filling material into the groove for forming the material rim.

With respect to the profile element of the second leg section, the cross section of which is substantially U-shaped, it is preferably provided that this profile element comprises two lateral webs extending substantially perpendicularly to the bridging section, which are connected to each other by a connecting section, wherein the connecting section is preferably inclined in such a way that the lateral web, which is adjacent to the planar element received in the space between the first and the second leg section of the profiled rail, is longer than the other lateral web. The angle of inclination may be more than 10°, e.g. between 10° and 45°, preferably between 25° and 40°, most preferably 35°.

Preferably, the profile element of the second leg section, the cross section of which is substantially U-shaped, is realized to have a width smaller than half the spacing between the first and the second planar element so as to procure sufficient space between the fixing element and the respective planar element for introducing the filling material.

Moreover, the fixing element should preferably have a depth which is approximately between 25% and 75% of the depth of the space to be covered or covered by the filling material. The depth of the space to be covered or covered by the filling material corresponds to the spacing of the spacer from the respective edges of the planar elements. This ensures that the filling material is in contact with a sufficient surface of the respective planar elements so as to provide a reliable non-positive connection while, at the same time, the substantially U-shaped profile element has a depth sufficient to ensure a secure attachment of the finished multiple glazing unit during use.

Furthermore, it is possible to provide a plurality of U-shaped profile elements, which jointly extend around the multiple glazing unit. Preferably, a number of fixing elements are provided which jointly extend substantially entirely around the circumference of the multiple glazing unit. This has the advantage that the best attachment of the multiple glazing unit on the support structure is obtained. If the multiple glazing unit has, for example, a generally rectangular shape, preferably four fixing elements are provided each of which extends along a corresponding edge of the multiple glazing unit, wherein the fixing elements are arranged at right angles relative to each other. As an alternative, fixing elements may be provided on only two edges of the multiple glazing unit, for example, on edges facing away from each other.

Preferably, the profiled rail is integrally made of a plastic material, specifically a PVC material.

In order to obtain the greatest possible stability of the assembly comprised of spacer, planar elements and fixing elements, the material rim preferably extends at least between the spacer and each of the planar elements.

Advantageously, the filling material is a resin material preferably curable at room temperature, or a silicone material preferably polymerizable at room temperature. Advantageously, the silicone material should be a material which is at least partially permanently elastic in the polymerized state. Of course, also other materials may be used.

Below, different preferred embodiments of profiled rails according to the present invention as well as the use of same during the production of a multiple glazing unit shall be explained by means of the accompanying drawings. It will be appreciated that the invention is not restricted to the embodiments of the profiled rail illustrated in the drawings, but any combinations of the individual features defined in the patent claims are possible.

In the drawings:

FIG. 1A-C each show a cross-sectional view of a profiled rail according to a first preferred embodiment, which is particularly suited during the production of a multiple glazing unit for positioning and provisionally fixing a fixing element in a groove formed between two planar elements spaced apart from each other;

Figure 3:
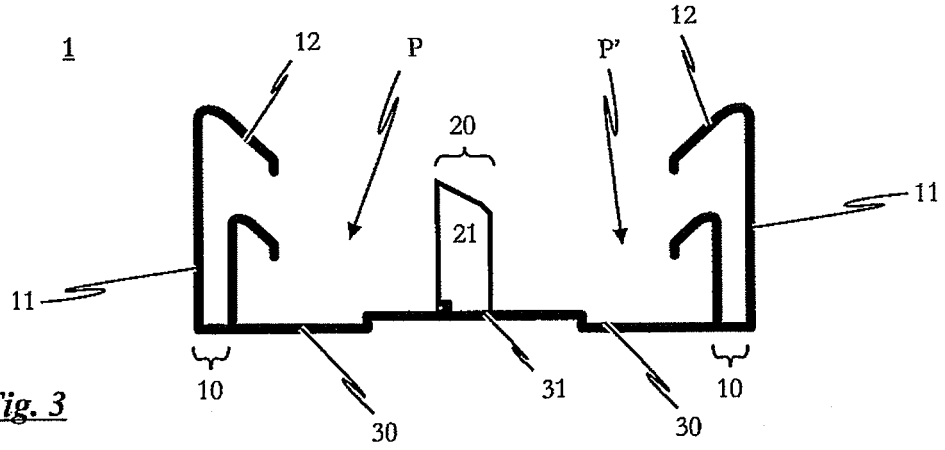
FIG. 3 shows a cross-sectional view of a profiled rail according to a third preferred embodiment, which is particularly suited during the production of a multiple glazing unit for provisionally fixing a fixing element in a groove formed between two planar elements spaced apart from each other at a position where the fixing element is not directly adjacent to one of the planar elements.
Figure 4:
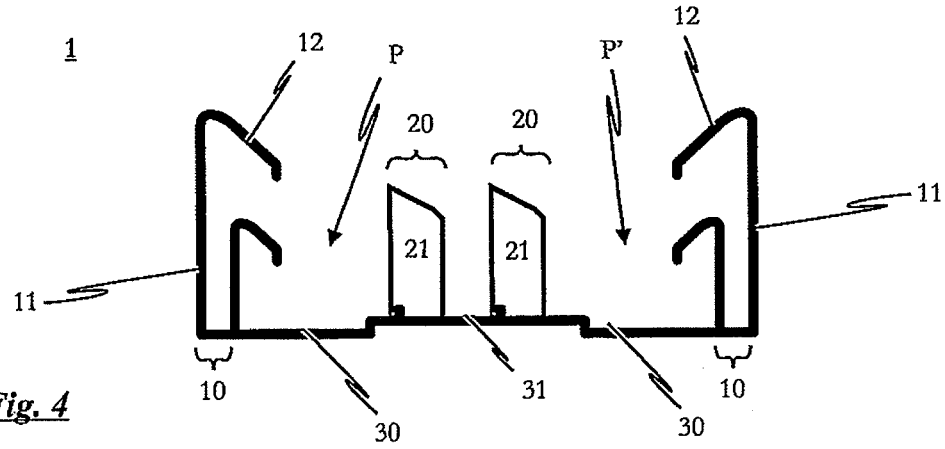
Figure 5B:
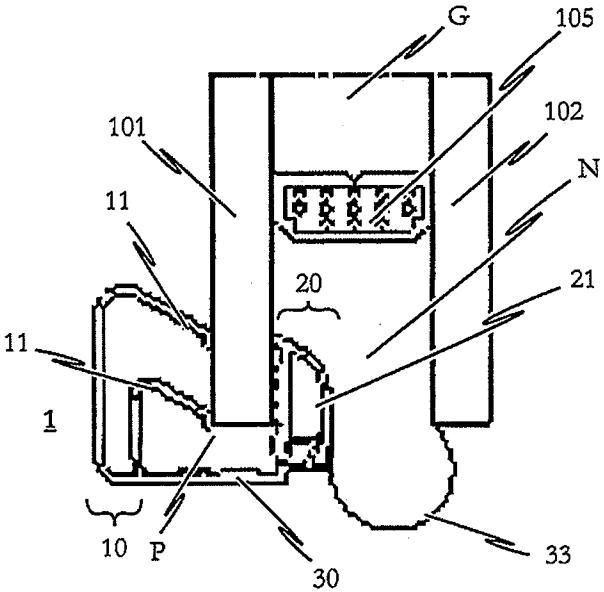
Figure 5A:
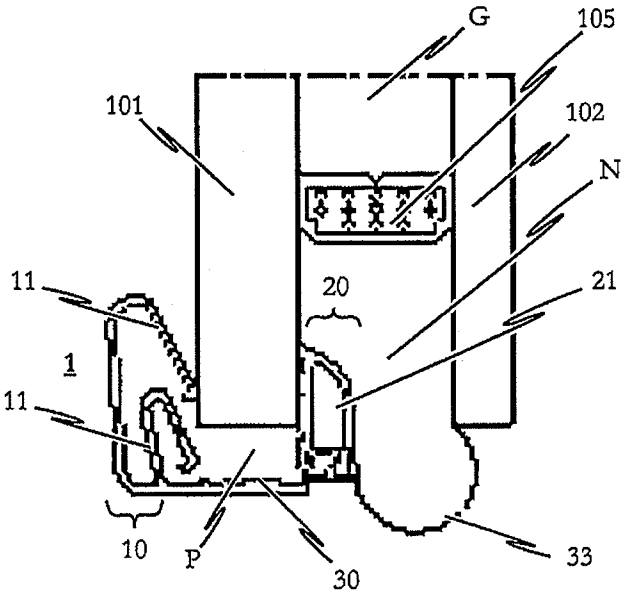
Figure 6B:
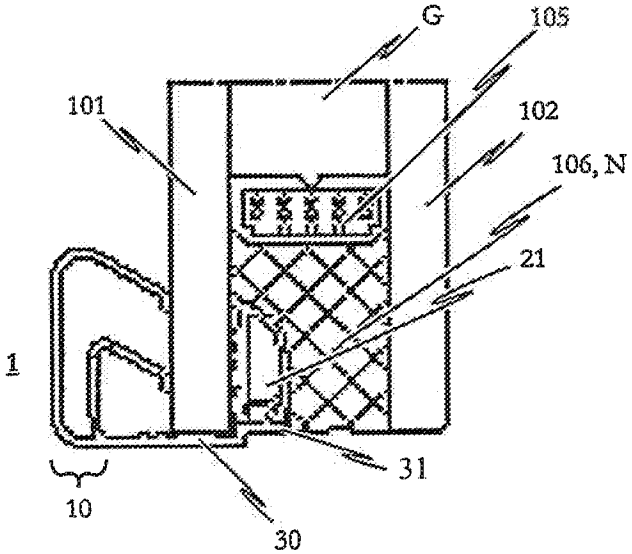
Figure 6A:
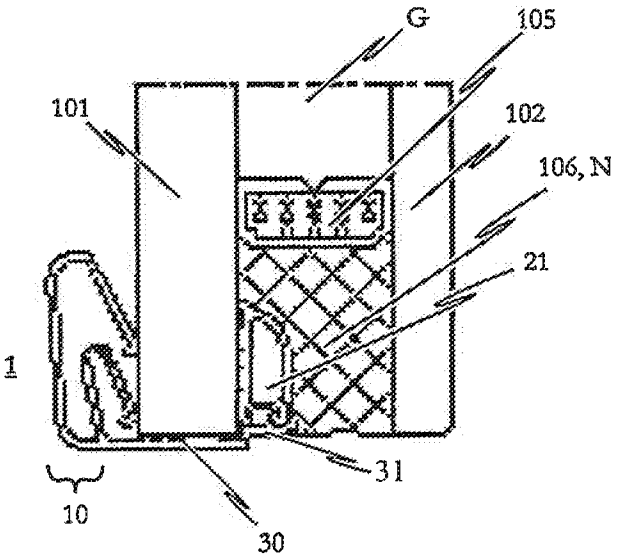
Figure 7B:
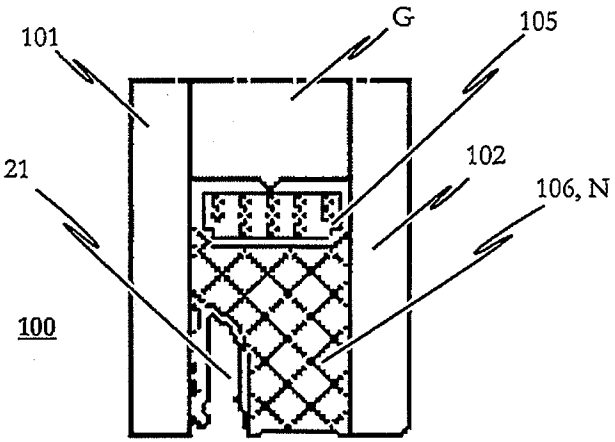
Figure 7A:
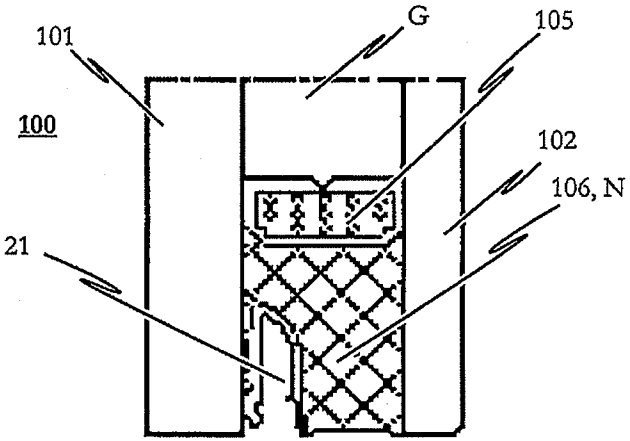

FIG. 4 shows a cross-sectional view of a fourth preferred embodiment of a profiled rail, which substantially corresponds to the profiled rail according to the third embodiment shown in FIG. 3 and which is particularly suited during the production of a multiple glazing unit for provisionally fixing simultaneously several fixing elements in a groove formed between two planar elements spaced apart from each other at a position where the fixing element is not directly adjacent to one of the planar elements;

FIGS. 5A, B each show a cross-sectional view of a not yet completed double glazing unit during the clamping of a profiled rail according to the first preferred embodiment for positioning and provisionally fixing the fixing element in a groove formed between the two planar elements spaced apart from each other;

FIGS. 6A, B each show a cross-sectional view of the double glazing unit shown in FIG. 5A and FIG. 5B after the clamping of the profiled rail and after forming a material rim in the groove formed between the two planar elements spaced apart from each other; and FIGS. 7A, B each show a cross-sectional view of the completed double glazing unit according to FIGS. 5A and 5B.

Figure 1A:
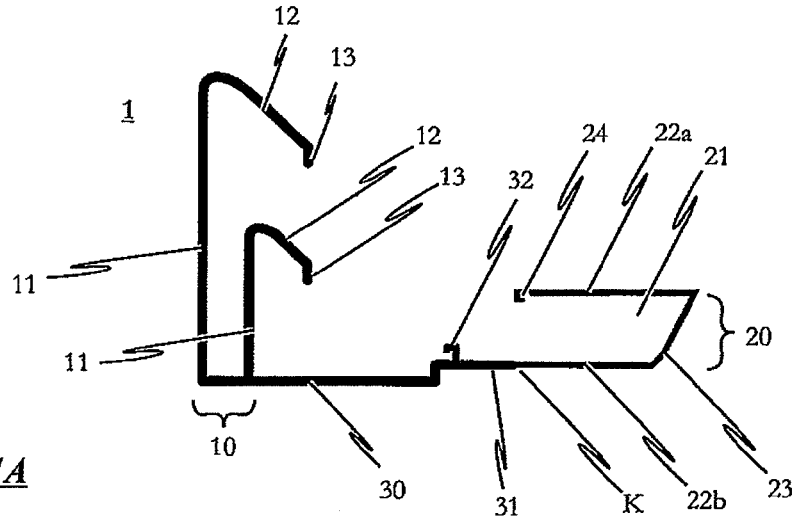
Figure 1B:
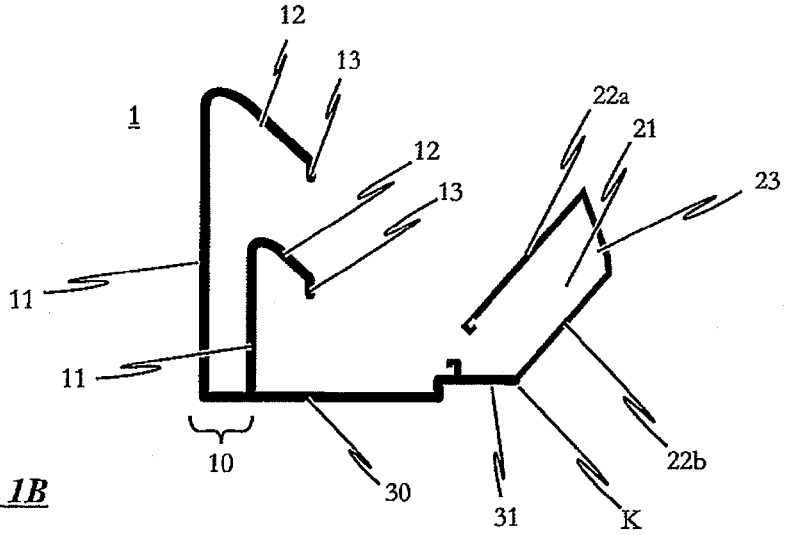
Figure 1C:
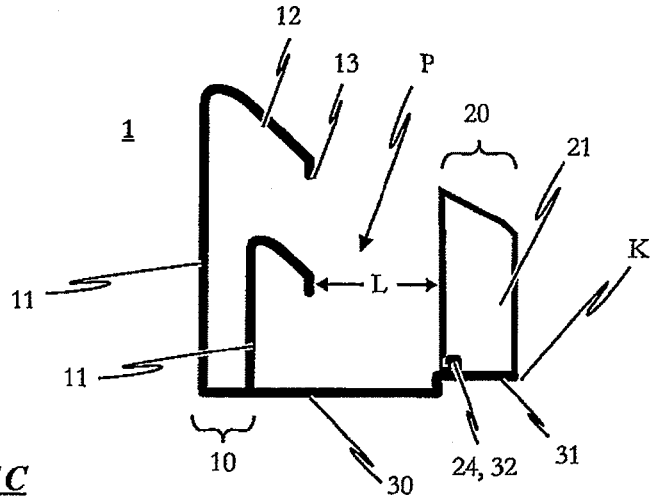

With reference to FIG. 1A to FIG. 1C a first preferred embodiment of a profiled rail 1 for positioning a fixing element 21 in a groove formed between two planar elements spaced apart from each other during the production of a multiple glazing unit shall be described below.

As is shown, the profiled rail 1 according to the first preferred embodiment comprises a first leg section 10, a second leg section 20 an a bridging section 30, 31 for connecting the first leg section 10 to the second leg section 20. It is provided that the first leg section 10 comprises two lateral webs 11 which are arranged substantially parallel to each other, each with a holding web 12 standing away from the associated lateral web 11. The holding webs 12 are each designed as a leaf-shaped element being resilient in the direction of the lateral web 11. On the respective free ends of the holding webs 12 a stop element 13 in the form of a lateral surface extending substantially perpendicularly relative to the bridging section 30, 31 is provided. When the profiled rail 1 is placed over the marginal section of a planar element, the marginal section of a planar element abuts against this stop element 13.

The second leg section 20 is separably connected to the bridging section 30, 31 and comprises a profile element 21 with a substantially U-shaped cross section which forms the fixing element when the profiled rail is used for the production of a multiple glazing unit. As is shown in FIG. 7A and FIG. 7B, the fixing element 21 defines a channel which, with respect to the multiple glazing unit 100, is open to the outside and which is adopted to receive a support element of a support structure not explicitly shown herein.

According to FIG. 1A to FIG. 1C the fixing element 21 has the shape of a profile with a U-shaped cross section, with two lateral webs 22*a* and 22*b*, which are connected to each other by a connecting section 23 which is preferably inclined at an angle of approximately 35°. By this it can be achieved that, when the multiple glazing unit 100 is completed, e.g. according to FIG. 7A and FIG. 7B, the filling material 106 can completely fill the space N between the spacer 105 and the planar elements 101, 102.

The separable connection of the second leg section 20 to the bridging section 30, 31 is accomplished by a predetermined breaking point K which is realized, for example, in the form of a notch in the transition between the second leg section 20 and the bridging section 30, 31. This connection between the bridging section 30, 31 and the second leg section 20 serves to separate the second leg section 20 from the bridging section 30, 31 easily and particularly without causing damage to the second leg section 20 when, during the production of a multiple glazing unit 100, the second leg section 20 with the substantially U-shaped profile element 21 is held by a filling material 106 in the groove N formed between two spaced apart planar elements 101, 102.

In the embodiment of the profiled rail 1 shown in FIG. 1A to FIG. 1C the predetermined breaking point K is provided between the second leg section 20 and the bridging section 30, 31 at the end of a step 31 of the bridging section 30, 31 in such a way that the second leg section 20 with the substantially U-shaped profile element 21 is pivotable from a first position shown in FIG. 1A into a second position shown in FIG. 1C (and vice versa), wherein the pivot point of this pivoting movement is located at the connection point K between the bridging section 30, 31 and the second leg section 20.

In the second position shown in FIG. 1C the second leg section 20 stands substantially perpendicularly on the bridging section 30, 31, while in the first position shown in FIG. 1A at least one lateral web 22*b* of the profile of the fixing element 21, which has a U-shaped cross section, lies substantially in the plane of the bridging section 30, 31.

In order to hold the second leg section 20 with the profile element 21, which has a substantially U-shaped cross section, in the second position according to FIG. 1C a locking mechanism 24, 32 is provided, which comprises a first locking member 24 at the free end of the lateral web 22*a* and a complementarily shaped second locking member 32 on the bridging section 30, 31. As is illustrated in FIG. 1B, both locking members 24, 32 can be brought into a preferably disengageable (positive) engagement when the second leg section 20 stands substantially perpendicularly relative to the bridging section 30, 31.

The bridging section 30, 31 comprises a first section 30 and a second section 31 which, with respect to the plane in which the first section 30 is disposed, is step-shaped. In the state of the second leg section 20 of the first embodiment of the profiled rail 1, which is shown in FIG. 1C, the step-shaped second section 31 of the bridging section 30, 31 defines a cover for the profile element 21, which has a substantially U-shaped cross section, so that the open channel of the substantially U-shaped profile element 21 located between the lateral webs 22*a*, 22*b* and the connecting section 23 is covered correspondingly. This cover formed by the second section 31 of the bridging section 30, 31 prevents filling material 106 from penetrating into the space enclosed between the lateral webs 22*a*, 22*b* and the connection section 23 when the profiled rail 1 is used during the production of the multiple glazing unit 100.

By forming the second section 31 of the bridging section 30, 31 step-shaped it can be achieved that the depth can be adjusted correspondingly, by means of which the profile element 21 of the second leg section 20, the cross section of which is substantially U-shaped, is held in the groove N formed between the two spaced apart planar elements 101, 102 of the multiple glazing unit 100 during the production of the same when the profiled rail 1 is non-positively connected to at least one marginal section 101', 102' of the two planar elements 101, 102, so that the at least one marginal section 101', 102' is received in a space P defined between the first and the second leg section 10, 20 and the second leg section 20 is held in the groove N formed between the two spaced apart planar elements 101, 102. It is obvious that the more strongly the step shape of the second section 31 of the bridging section 30, 31 is formed relative to the first section 30 of the bridging section 30, 31, the deeper can the profile element 21 of the second leg section 20, the cross section of which is substantially U-shaped, be positioned in the groove N formed between the two spaced apart planar elements 101, 102 of the multiple glazing unit 100.

Below, the details of the profiled rail 1 according to the first embodiment shall be described in connection with FIG. 5 to FIG. 7. These figures illustrate how a multiple glazing unit 100 can be produced with the aid of the profiled rail 1.

In detail, the synopsis of FIGS. 1 and 5 to 7 shows that the first and second leg sections 10, 20 of the profiled rail 1 according to FIG. 1C are formed on the bridging section 30, 31 in such a way that the profiled rail 1 is connectable, specifically non-positively, to at least one marginal section 101', 102' of the two planar elements 101, 102 forming the multiple glazing unit 100, so that the at least one marginal section 101', 102' is received in the space P defined between the first and second leg section 10, 20 and the second leg section 20 is held in the groove N formed between the two spaced apart planar elements 101, 102.

During the production of the multiple glazing unit 100 the holding of the second leg section 20 in the groove N formed between the two spaced apart planar elements 101, 102 serves to position and provisionally fix the profile element 21 of the second leg section 20, the cross section of which is substantially U-shaped, in the groove N, before the groove N is filled with the filling material 106.

By forming in accordance with the invention the first and second leg sections 10, 20 of the profiled rail 1 on the bridging section 30 of the profiled rail 1 in such a way that, as is particularly shown in FIG. 5A and FIG. 5B, during the production of the multiple glazing unit 100 the profiled rail 1 can be placed over at least one marginal section 101', 102' of the two planar elements 101, 102, wherein at least one marginal section 101', 102' of the two planar elements 101, 102 of the multiple glazing unit 100 to be produced is positively received in the space P defined between the first and the second leg section 10, 20, it can be achieved that, by means of the profiled rail 1, the fixing element 21 can be optimally positioned in the groove N formed between the respective marginal sections 101', 102' of the two spaced apart planar elements 101, 102 in a particularly easy and faultless manner.

In the profiled rails 1 illustrated in the drawings, at least one first leg section 10 comprises at least one lateral web 11 extending substantially perpendicularly relative to the bridging section 30, with at least one holding web 12 standing away from the lateral web 11 in the direction to the second leg section 20. This embodiment is particularly suited if the spacing L between the at least one lateral web 11 and the side of the profile element 21 of the second leg section 20, said side facing the first leg section 10 and said profile element 21 having a substantially U-shaped cross section, is greater than the thickness of the marginal section 101', 102' of the planar element 101, 102 to be received in the space P defined between the first and the second leg section 10.

As is illustrated in FIG. 5A and FIG. 5B it is, in this connection, particularly provided with respect to the profiled rail 1 that the at least one holding web 12 standing away from the lateral web 11 is formed in such a way that, if the profiled rail 1 is placed over the marginal section 101' of the planar element 101, it abuts against the side of that planar element 101 the marginal section 101' of which is received in the space P defined between the first and the second leg section 10, 20, said side facing the first leg section 10.

Alternatively it would, of course, also be possible to form the profiled rail 1 in such a way that at least one first leg section 10 comprises at least one lateral web 11 extending substantially perpendicularly relative to the bridging section 30, wherein the spacing L between the at least one lateral web 11 and the side of the profile element 21 of the second leg section 20, said side facing the first leg section 10 and said profile element 21 having a substantially U-shaped cross section, is substantially identical with the thickness of the marginal section 101', 102' of the planar element 101, 102 to be received in the space P defined between the first and the second leg section 10, 20.

However, if the profiled rail 1 is formed in such a way that the spacing L between the at least one lateral web 11 of the first leg section 10 and the side of the profile element 21 of the second leg section 20, said side facing the first leg section 10 and said profile element 21 having a substantially U-shaped cross section, is greater than the thickness of the marginal section 101', 102' of the planar element 101, 102 to be received in the space P defined between the first and the second leg section 10, 20, it is preferred to form the at least one holding web 12 standing away from the at least one lateral web 11 of the first leg section 10 as a preferably leaf-shaped element being resilient in the direction of the associated lateral web 11. Here, it would, for example, be possible that the at least one holding web 12 standing away from the at least one lateral web 11 of the first leg section 10 is made of a flexible material and/or, in contrast to the material of the lateral web 11, is of a soft consistency.

Then, as is shown in FIG. 5 to FIG. 7, one and the same profiled rail 1 with differently strong planar elements 101, 102 may be used for the production of multiple glazing units 100, as the spacing L between the first and the second leg section 10, 20 of the profiled rail 1 and, thus, also the dimension of the space P defined between the first and the second leg section 10, 20 is flexible to a certain degree and adapts itself to the thickness of the marginal section 101', 102' of the planar element 101, 102 to be received.

In this respect reference is made to FIG. 5A to FIG. 7A, on the one hand, and to FIG. 5B to FIG. 7B, on the other hand. Both FIG. 5A to FIG. 7A and FIG. 58 to FIG. 7B each show different states during the production of a multiple glazing unit 100 by using the profiled rail 1 shown in FIG. 1C, whereby it can be recognized that the profiled rail 1 with the at least one holding web 12 standing away from the at least one lateral web 11 of the first leg section 10, which is formed as a preferably leaf-shaped element being resilient in the direction of the associated lateral web 11, can be placed over differently thick marginal sections 101' of the respective planar element 101, with the marginal section 101' in question basically being received in the space P defined between the first and the second leg section 10, 20 in a positive manner.

Figure 2:
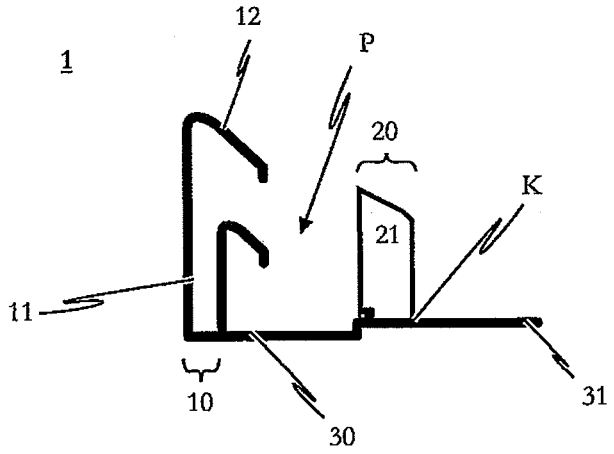
FIG. 2 shows a cross-sectional view of a profiled rail according to a second preferred embodiment, which, in comparison with the profiled rail according to FIG. 1, comprises an elongated bridging section.

With reference to FIG. 2 to FIG. 4 other preferred embodiments of the profiled rail 1 shall be described below, which, during the production of a multiple glazing unit 100, are particularly suited for positioning and provisionally fixing a fixing element 21 in a groove N formed between two planar elements 101, 102 spaced apart from each other.

FIG. 2 shows a cross-sectional view of a profiled rail 1 according to a second preferred embodiment which is, in principle, identical with the profiled rail according to the first preferred embodiment, but has, in comparison with the profiled rail according to FIG. 1C, an elongated bridging section 30, 31. In detail, the step-shaped second section 31 of the bridging section 30, 31 of the profiled rail 1 according to FIG. 2 extends clearly over the opening of the channel of the substantially U-shaped profile element 21, the channel being defined by the lateral webs 22*a*, 22*b* and the connecting section 23, so that the separable connection (predetermined breaking point K) between the second leg section 20 and the bridging section 30, 31 is located away from the free end of the second section 31 of the bridging section 30, 31.

Thus, the bridging section 30, 31 of the profiled rail 1 according to the second preferred embodiment shown in FIG. 2 not only has the function to cover the profile element 21, the cross section of which is substantially U-shaped, but additionally has the function of covering the preferably total groove N if the profiled rail 1—as is shown in FIG. 5A or FIG. 5B—is, for example, placed over the marginal section 101' of the planar element 101 so that the marginal section 101' is positively received in the space P defined between the first and the second leg section 10, 20.

Preferably, the bridging section 30, 31 is in cross section at least of the same length as the spacing between the planar elements 101, 102 of the multiple glazing unit 100 to be produced, which substantially simplifies the formation of the material rim 106 during the production of the multiple glazing unit 100. That is, if the profiled rail 1 is non-positively connected to at least one marginal section 101', 102' of the two planar elements 101, 102 and the at least one marginal section 101', 102' is received in the space P defined between the first and the second leg section 10, 20, the bridging section 30, 31 covers the groove N formed between the two spaced apart planar elements 101, 102, in which also the profile element 21 having a substantially U-shaped cross section is held by the profiled rail 1. During subsequently forming the material rim 106 by filling a filling material into the groove N, the bridging section 30, 31 covering the groove N retains the originally flowable filling material in the groove N until the filling material is sufficiently solidified.

FIG. 3 shows a cross-sectional view of a profiled rail 1 according to a third preferred embodiment, which is particularly suited during the production of a multiple glazing unit 100 for provisionally fixing a fixing element 21 in a groove N formed between two planar elements 101, 102 spaced apart from each other at a position where the fixing element 21 is not directly adjacent to one of the planar elements 101, 102. Contrary to the first and second embodiment of the profiled rail 1, the third embodiment shows a profiled rail which has a total of two first leg sections 10, 10' connected to the bridging section 30, 31 in such a way that the second leg section 20 is arranged between the two first leg sections 10, 10' and that a space P, P' is defined between one of the first leg sections 10, 10' and the second leg section 20, whereby the two first leg sections 10, 10' are formed on the bridging section 30, 31 in such a way that the profiled rail 1 can be placed over both marginal sections 101', 102' of the planar elements 101, 102 forming the multiple glazing unit 100 to be produced, so that a marginal section 101', 102' of the two planar elements 101, 102 is received in one of the spaces P, P' defined by the leg sections 10, 10', 20 and the second leg section 20 is held in the groove N between the two spaced apart planar elements 101, 102.

FIG. 4 shows a cross-sectional view of a fourth preferred embodiment of a profiled rail 1, which substantially corresponds to the profiled rail according to the third embodiment shown in FIG. 3 and which is particularly suited during the production of a multiple glazing unit 100 for provisionally fixing simultaneously several fixing elements 21 in a groove N formed between two planar elements 101, 102 spaced apart from each other at a position where the fixing element 21 is not directly adjacent to one of the planar elements 101, 102.

It is obvious that the above-described profiled rails 1 are particularly suited for use in the production of a multiple glazing unit 100, where a fixing element 21 is arranged in a groove N formed between two spaced apart planar elements 101, 102, wherein this fixing element 21 is defined by the profile element 21, the cross section of which is substantially U-shaped, of the profiled rail 1.

With reference to FIG. 5 to FIG. 7 the inventive method for producing a multiple glazing unit 100 shall be described below. FIG. 5 to FIG. 7 show in detail how multiple glazing units 100 with differently strong planar elements 101 are producible with the use of the profiled rail 1 according to FIG. 1C.

For both multiple glazing units 100 to be produced, FIG. 5A and FIG. 5B each show a cross-sectional view of a not yet completed double glazing unit during the clamping of a profiled rail 1 according to the first preferred embodiment for positioning and provisionally fixing the fixing element 21 in the groove N formed between the two planar elements 101, 102 spaced apart from each other.

FIG. 6A and FIG. 6B each show a cross-sectional view of the double glazing unit 100 shown in FIG. 5A and FIG. 5B after the clamping of the profiled rail 1 and after forming a material rim 106 in the groove N formed between the two planar elements 101, 102 spaced apart from each other, while FIG. 7A and FIG. 7B each show a cross-sectional view of the completed double glazing unit 100 according to FIGS. 5A and 5B.

During the inventive method for producing a multiple glazing unit 100, initially a profiled rail 1 and two preferably vitreous planar elements 101, 102 are provided. Next, the two planar elements 101, 102 are arranged in a face-to-face and spaced apart relationship, wherein the spacing between the planar elements 101, 102 is defined by a spacer 105 arranged between the planar elements 101, 102, and wherein the two planar elements 101, 102 are arranged in such a way that a gas space G is enclosed between the spaced apart planar elements 101, 102 and the spacer 105 on the one hand, and that a groove N extending at least partially peripherally is formed with the respective marginal sections 101', 102' of the planar elements 101, 102 and the spacer 105 on the other hand.

As is shown in FIG. 5A and FIG. 5B, the profiled rail 1 is then placed onto the groove N formed with the respective marginal sections 101', 102' of the planar elements 101, 102 and the spacer 105 in such a way that at least one marginal section 101', 102' of the two planar elements 101, 102 is received in the space P defined between the first and the second leg section 10, 20 of the profiled rail 1 and the second leg section 20 of the profiled rail 1 is held in the groove N formed between the two planar elements 101, 102 spaced apart from each other.

Next, a material rim 106 is formed in the groove N, which is preferably accomplished by incorporating a filling material (33)into the groove N in such a way that the second leg section 20 of the profiled rail 1 is at least partially enclosed by the filling material. FIG. 6A and FIG. 6B show the multiple glazing unit 100 with the already formed material rim 106.

Finally, the connection K between the second leg section 20 and the bridging section 30, 31 of the profiled rail 1 is separated, so that the multiple glazing unit 100 is completed. FIG. 7A and FIG. 7B each show a cross-sectional view of the completed multiple glazing unit 100, which is provided with the two planar elements 101, 102 spaced apart from each other, wherein the first planar element 101 forms, for example, the inner pane of the glazing unit 100. Between the planar elements 101, 102 the gas space G is limited by the peripherally extending spacer 105 which is formed, for example, of electroplated steel, wherein a layer of a sealing material such as polyisobutylene may preferably be placed between the spacer 105 and each of the panes 101, 102.

Moreover, the material rim 106 is provided in the completed double glazing unit 100 according to FIG. 7A and FIG. 7B, which fills up the space N between the spacer 105 and the planar elements 101, 102 and which holds the two planar elements 101, 102 next to each other. In order to form a device for fixing the multiple glazing unit 100 to a (non-illustrated) support structure, the fixing element 21 is immersed into the filling material 106.

In the completed multiple glazing unit 100 shown in FIG. 7A and FIG. 7B the free ends of the lateral webs 22*a*, 22*b* defining the fixing element are adjacent to the edge of the two planar elements 101, 102 in a substantially flush manner. However, the invention is not restricted to such a flush adjacency. In a case of need, the use of the profiled rail 1 rather permits to position the fixing element 21 also deeper in the groove N or at other positions within the groove N.

Basically, however, the fixing element 21 should have a width which is preferably smaller than half the distance between the spaced apart planar elements 101, 102. Thus, it can be ensured that, when forming the material rim 106, the filling material comes into contact with a sufficiently large surface of the planar elements 101, 102 in order to provide for a reliable adhesion.

The invention is not limited to the preferred embodiment of the profiled rail 1 illustrated in the drawings, but any combinations of the individual features defined in the patent claims in respect of the profiled rail 1 are possible. Specifically, also the inventive method for producing a multiple glazing unit 100 is not only limited to the use of the profiled rail shown in FIG. 1C. In this respect it is, of course, also possible that, during the inventive method, the method step of placing the profiled rail onto the groove is performed after the method step of forming the material rim in the groove, with the profiled rail being placed onto the groove in such a way that the second leg portion of the profiled rail is at least partially enclosed by the filling material incorporated into the groove.

In addition it is pointed out that the profiled rail is preferably made of a plastic material, specifically polyethylene, polypropylene or polyethylene terephthalate. Of course, also other materials, such as a metal, may be used.

The invention claimed is:

1. A profiled rail comprising:

(a) a first leg section;

(b) a second leg section;

(c) a bridging section connected to the first leg section and the second leg section;

wherein the bridging section is separably connected to the second leg section via a predetermined breaking point for removal of the second leg section from the bridging section;

wherein the first leg section comprises a holding section adapted to hold a portion of a planar element of a multiple glazing unit during production of the multiple glazing unit;

wherein the second leg section comprises a profile element adapted to be held in the multiple glazing unit;

wherein the profile element is U-shaped;

wherein the profile element comprises a first lateral web, a second lateral web spaced from and opposite the first lateral web, and a connecting section connecting an end portion of the first lateral web to a corresponding end portion of the second lateral web; and wherein the connection section is inclined at an angle of from 10° to 45°.

2. The profile rail of claim 1, Wherein the second leg section is selectively positionable from a first position to a second position.

3. The profile rail of claim 2, wherein the second leg section is selectively positionable about the predetermined breaking point.

4. The profile rail of claim 3, wherein the first position is a resting position and the second position is a manufacturing position.

5. The profile rail of claim 4, comprising:

a locking mechanism adapted to lock the second leg section in the manufacturing position.

6. The profile rail of claim 5, wherein the locking mechanism comprises:

a first locking member located at a free end of a lateral web of the second leg section, wherein the lateral web forms a portion of the profile element; and a second locking member located on the bridging section, wherein the second locking member is complementary to the first locking member.

7. The profile rail of claim 1, wherein the predetermined breaking point (K) comprises a notch.

8. The profile rail of claim 1, wherein the holding section is leaf shaped and comprises a holding web having a free end and a lateral web, wherein the lateral web is connected to both (i) a non-free end of the holding web and (ii) a portion of the bridging section.

9. The profile rail of claim 8, wherein the free end of the holding web comprises a stop.

10. A method comprising:

contacting a first side of a first vitreous planar element via a first leg of a profile rail;

contacting a second side of the first vitreous planar element via a second leg of the profile rail, wherein the profile rail comprises a bridging section that is connected to the first leg section and the second leg section, wherein the bridging section is separably connected to the second leg section via a predetermined breaking point;

incorporating a filling material into a groove associated with the first vitreous planar element, wherein the filing the material is a resin material or a silicone material, wherein the groove is at least partially defined by the second side of the first vitreous planar element and a first side of a second vitreous planar element, wherein, during the incorporating, the second side of the first vitreous planar element is substantially parallel to the first side of the second vitreous planar element; and after the incorporating step, removing the second leg section from the profile rail via the predetermined breaking point, thereby creating a multiple glazing unit having at least a portion of the second leg section therein.

11. The method of claim 10, wherein the incorporating step comprises at least partially enclosing the second leg portion via the filling material.

12. The method of claim 11, wherein both contacting steps occur before the incorporating step.

13. The method of claim 11, wherein both contacting steps occur after or concomitant to the incorporating step.

14. The method of claim 10, comprising:

arranging the first vitreous planar element and the second vitreous planar element in a face-to-face and spaced apart relationship, wherein a spacer is used for the spaced apart relationship, and wherein the spacer is arranged between the first vitreous planar element and the second vitreous planar element.

15. The method of claim 14, wherein, after the removing step, the second leg section is separated from the spacer by the filling material.

16. A profiled rail comprising:

(a) a first leg section;

(b) a second leg section;

(c) a bridging section connected to the first leg section and the second leg section;

wherein the bridging section is separably connected to the second leg section via a predetermined breaking point for removal of the second leg section from the bridging section;

wherein the first leg section comprises a holding section adapted to hold a portion of a planar element of a multiple glazing unit during production of the multiple glazing unit;

wherein the second leg section comprises a profile element adapted to be held in the multiple glazing unit;

wherein the profile element is U-shaped;

wherein the profile element comprises a first lateral web, a second lateral web spaced from and opposite the first lateral web, and a connecting section connecting an end portion of the first lateral web to a corresponding end portion of the second lateral web; and wherein the connection section is inclined at an angle of from 25° to 40°.

17. The profile rail of claim 16, wherein the second leg section is selectively positionable from a first position to a second position.

18. The profile rail of claim 17, wherein the second leg section is selectively positionable about the predetermined breaking point.

19. The profile rail of claim 18, wherein the first position is a resting position and the second position is a manufacturing position.

20. The profile rail of claim 19,comprising:

a locking mechanism adapted to lock the second leg section in the manufacturing position.

21. The profile rail of claim 20, wherein the locking mechanism comprises:

a first locking member located at a free end of a lateral web of the second leg section, wherein the lateral web forms a portion of the profile element; and a second locking member located on the bridging section, wherein the second locking member is complementary to the first locking member.

22. The profile rail of claim 16, wherein the predetermined breaking point comprises a notch.

23. The profile rail of claim 16, wherein the holding section is leaf shaped and comprises a holding web having a free end and a lateral web, wherein the lateral web is connected to both (i) a non-free end of the holding web and (ii) a portion of the bridging section.

24. The profile rail of claim 23, wherein the free end of the holding web comprises a stop.

* * * * *

UNITED STATES PATENT AND TRADEMARK OFFICE

CERTIFICATE OF CORRECTION

PATENT NO. : 8,702,082 B2
APPLICATION NO. : 12/526257
DATED : April 22, 2014
INVENTOR(S) : Bernard Amouroux et al.

It is certified that error appears in the above-identified patent and that said Letters Patent is hereby corrected as shown below:

In the Claims

Column 13, line 51, Claim 2, delete "Wherein" and insert --wherein--;

Column 14, lines 23 and 24, Claim 10, after the words "wherein the" delete the words "filing the" and insert --filling--.

Signed and Sealed this
Twenty-fifth Day of August, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,702,082 B2
APPLICATION NO. : 12/526257
DATED : April 22, 2014
INVENTOR(S) : Amouroux et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1294 days.

Signed and Sealed this
Twenty-ninth Day of September, 2015

Michelle K. Lee

Michelle K. Lee
*Director of the United States Patent and Trademark Office*